US005850236A

United States Patent [19]

Murai et al.

[11] Patent Number: 5,850,236

[45] Date of Patent: Dec. 15, 1998

[54] PREFIRING METHOD FOR AN INK-JET HEAD AND APPARATUS HAVING THE INK-JET HEAD WITH THE PREFIRING METHOD

[75] Inventors: Yukako Murai; Tamio Amagai; Yoshio Tabata, all of Kawasaki, Japan

[73] Assignee: Fujitsu Limited, Kawasaki, Japan

[21] Appl. No.: 592,858

[22] Filed: Jan. 24, 1996

[30] Foreign Application Priority Data

Apr. 20, 1995 [JP] Japan ..... 7-094780

[51] Int. Cl.[6] ..... B41J 2/165; B41J 29/38; B41J 2/05

[52] U.S. Cl. ..... 347/23; 347/14; 347/35; 347/60

[58] Field of Search ..... 347/22, 23, 14, 347/29, 35, 60

[56] References Cited

U.S. PATENT DOCUMENTS

| | | | |
|---|---|---|---|
| 3,925,788 | 12/1975 | Kashio | 347/23 |
| 3,925,789 | 12/1975 | Kashio | 347/23 |
| 4,540,997 | 9/1985 | Biggs et al. | 347/23 |
| 4,558,332 | 12/1985 | Takahashi | 347/14 |
| 4,970,527 | 11/1990 | Gatten | 347/23 |
| 5,428,379 | 6/1995 | Kaneko et al. | 347/23 |
| 5,530,461 | 6/1996 | Sakuma | 347/23 |
| 5,710,581 | 1/1998 | Barton et al. | 347/23 |

FOREIGN PATENT DOCUMENTS

| | | |
|---|---|---|
| 0 589 581 A2 | 3/1994 | European Pat. Off. . |
| 33 11 735 A1 | 10/1983 | Germany . |
| 63-252748 | 10/1988 | Japan . |

*Primary Examiner*—Peter S. Wong
*Assistant Examiner*—Bao Q. Vu
*Attorney, Agent, or Firm*—Nikaido, Marmelstein, Murray & Oram LLP

[57] ABSTRACT

An apparatus having an ink-jet head has a time measuring unit, a recording unit, and a prefiring operation control unit. The time measuring unit is used to measure an elapsed time from execution of prefiring operations for the ink-jet head, and the recording unit is used to record whether or not printing nozzles disposed in the ink-jet head are operated. The prefiring operation control unit determines a number of prefiring operations in accordance with a measurement result obtained by the time measuring unit and operated conditions of the printing nozzles recorded in the recording means, and executes prefiring operations for the ink-jet head. Therefore, the apparatus is capable of executing prefiring operations often enough and sufficient for the actual operated conditions of the printing nozzles disposed in the ink-jet head, and thereby preventing ink from being consumed at enhanced rate by useless prefiring operations.

25 Claims, 14 Drawing Sheets

Fig. 7

5

REGISTER No. 1

| NOZZLE No. 12 | NOZZLE No. 11 | NOZZLE No. 10 | NOZZLE No. 9 | NOZZLE No. 8 | NOZZLE No. 7 | NOZZLE No. 6 | NOZZLE No. 5 |
|---|---|---|---|---|---|---|---|
| 0:OFF 1:ON | 0:OFF 1:ON | 0:OFF 1:ON | 0:OFF 1:ON | 0:OFF 1:ON | 0:OFF 1:ON | 0:OFF 1:ON | 0:OFF 1:ON |

REGISTER No. 2

| NOZZLE No. 4 | NOZZLE No. 3 | NOZZLE No. 2 | NOZZLE No. 1 | — | — | — | — |
|---|---|---|---|---|---|---|---|
| 0:OFF 1:ON | 0:OFF 1:ON | 0:OFF 1:ON | 0:OFF 1:ON | UNUSED | UNUSED | UNUSED | UNUSED |

Fig.9

| N | MEAN NUMBER OF OPERATIONS PER MINUTE |
|---|---|
| 2 | 10 |
| 3 | 20 |
| 4 | 30 |
| ⋮ | ⋮ |
| n | ⋮ |

PREFIRING METHOD FOR AN INK-JET HEAD AND APPARATUS HAVING THE INK-JET HEAD WITH THE PREFIRING METHOD

BACKGROUND OF THE INVENTION

1. Field of the Invention

The present invention relates to a prefiring technology for an ink-jet head, and more particularly, to a prefiring method for an ink-jet head and an apparatus having an ink-jet head which uses the prefiring method.

2. Description of the Related Art

Recently, ink-jet type printing heads (ink-jet heads) are widely used. In the ink-jet head, nozzles used for ejecting ink (droplet of ink) disposed to the ink-jet head may be choked with dried ink and the ink cannot be easily ejected through the nozzles. In such a case, the printing head (ink-jet head) poses a problem that the ink-jet head prints out characters in a faint condition due to an insufficient amount of discharged (ejected) ink when an attempt is made to use the ink-jet head for printing out characters while electing ink.

In order to prevent characters from being printed out in such a faint condition, known to those skilled in the art is a method to correct the checked conditions of the nozzles by blowing ink several times through the nozzles of the ink-jet head, prior to practical printing operations. Such a process is generally called a "prefiring operation".

SUMMARY OF THE INVENTION

An object of the present invention is to provide a method which is constituted to execute prefiring operations often enough and sufficient for practical operating conditions of printing nozzles disposed in an ink-jet head, and thereby preventing ink from being consumed at enhanced rate by useless prefiring operations.

According to the present invention, there is provided an apparatus having an ink-jet head comprising a time measuring unit for measuring an elapsed time from execution of prefiring operations for the ink-jet head; a recording unit for recording whether or not printing nozzles disposed in the ink-jet head are operated; and a prefiring operation control unit which determines a number of prefiring operations in accordance with a measurement result obtained by the time measuring unit and the operated conditions of the printing nozzles recorded in the recording unit, and executes prefiring operations for the ink-jet head.

The recording unit may be constituted to record whether or not the printing nozzles disposed in the ink-jet head are operated. The prefiring operation control unit may be constituted to initialize a time measured by the time measuring unit, and also initialize operated conditions of the printing nozzles recorded in the recording unit upon execution of the prefiring operations for the ink-jet head.

The prefiring operation control unit may determine a number of prefiring operations in accordance with an elapsed time from preceding prefiring operations which is measured by the time measuring unit when the operated conditions of the printing nozzles are not recorded in the recording unit, and the prefiring operation control unit may determine a number of prefiring operations by dividing, by a specific value, an elapsed time from the preceding prefiring operations which is measured by the time measuring unit when the operated conditions of the printing nozzles are recorded in the recording unit. The recording unit may record numbers of operations of the printing nozzles, the prefiring operation control unit may determine the specific value corresponding to the number of operations of the printing nozzles recorded in the recording unit, and the prefiring operation control unit may determine a number of prefiring operations by dividing the elapsed time from the preceding prefiring operations by the specific value.

The apparatus may further comprise a condition detecting unit for detecting whether or not the ink-jet head is abnormal; a condition recording unit for recording the abnormal condition of the ink-jet head; a condition judging unit for judging a condition of the ink-jet head at the time of the recording; and a checking unit for comparing the condition recorded in the condition recording unit with the condition of the ink-jet head judged by the condition judging unit, wherein the prefiring operation control unit executes prefiring operations for the ink-jet head, when the condition recorded in the condition recording unit is different from the condition of the ink-jet head judged by the condition judging unit.

The apparatus may further comprise a head replacement judging unit for judging whether or not the ink-jet head was replaced with a new one, wherein the prefiring operation control unit executes prefiring operations for the ink-jet head, when the head replacement judging unit judges that the ink-jet head was replaced with the new one. The apparatus may further comprise a printed sheet number counting unit for counting printed sheets, and the prefiring operation control unit executes prefiring operations for the ink-jet head, when the printed sheets counted by the printed sheet number counting unit reaches a predetermined number.

According to the present invention, there is also provided an image reader having an image reader controller connected to a host unit, an endorser controller connected to the image reader controller, and an ink-jet head controlled by the endorser controller, characterized in that the prefiring operation control unit comprises an unused time counter for measuring an elapsed time from execution of prefiring operations for the ink-jet head and a nozzle management register for recording whether or not printing nozzles disposed in the ink-jet head are operated, wherein the endorser controller determines a number of prefiring operations in accordance with a measurement result obtained by the unused time counter and the operated conditions of the printing nozzles recorded in the nozzle management register, and executes prefiring operations for the ink-jet head.

The image reader controller may comprise an interface analyzer, connected to the host unit, for checking printing data sent from the host unit for a format thereof; an intermediate register, connected to the interface analyzer, for storing the printing data sent from the interface analyzer, when the interface analyzer judges that the printing data has a normal format; a mechanical operation controller, connected to the intermediate register, for controlling mechanical operations of the image reader by outputting print commands; and an endorser register, connected to the mechanical operation controller, for transferring the print commands from the mechanical operation controller to the endorser controller.

Further, according to the present invention, there is provided a prefiring method for an ink-jet head constituted to prevent choking of a plurality of printing nozzles disposed in the ink-jet head by discharging ink from the printing nozzles, characterized in that the prefiring method comprises the steps of measuring an elapsed time from execution of prefiring operations for the ink-jet head; recording operated conditions of the printing nozzles after the execution of the prefiring operation; determining a number of prefiring operations in accordance with the elapsed time from the execution of the prefiring operations for the ink-jet head and the operated conditions of the printing nozzles; and executing the determined number of prefiring operations for the ink-jet head.

The operated condition recording step may record operated conditions of each of the printing nozzles disposed in the ink-jet head. The prefiring number determining step may determine a number of prefiring operations corresponding to the elapsed time from the execution of the prefiring operations when the printing nozzles are not operated even once, and may determine a number of prefiring operations as a quotient obtained by dividing the elapsed time from execution of the preceding prefiring operations by a specific value. The prefiring number determining step may determine a number of prefiring operations corresponding to the elapsed time from the execution of the prefiring operations when any one of the printing nozzles are not operated. The time measuring step may count operated frequencies of the printing nozzles disposed in the ink-jet head, and the prefiring number determining step may determine a number of prefiring operations by dividing the elapsed time from the execution of the prefiring operations by the specific value determined in accordance with the operated frequencies of the printing nozzles.

The prefiring method may further comprise the steps of detecting an abnormal condition of the ink-jet head; recording the abnormal condition of the ink-jet head; judging a condition of the ink-jet head before the execution of the prefiring operations; and checking the recorded condition of the ink-jet head against the judged condition thereof, wherein the prefiring operation executing step executes prefiring operations for the ink-jet head, when the checked results are not coincident with each other.

The prefiring method may further comprise the step of judging whether or not the ink-jet head was replaced with a new one, wherein the prefiring operation executing step executes prefiring operations for the ink-jet head, after the ink-jet head is replaced with a new one. The prefiring operation executing step may execute prefiring operations for the ink-jet head, when a number of printed sheets printed by the ink-jet head reaches a predetermined number.

BRIEF DESCRIPTION OF THE DRAWINGS

The present invention will be more clearly understood from the description of the preferred embodiments as set forth below with reference to the accompanying drawings, wherein:

FIG. 7 is a diagram showing an example of a nozzle management register for controlling printing nozzles disposed in the ink-jet head shown in FIG. 4;

FIG. 9 is a diagram showing relationship between numbers of prefiring operations and values of a coefficient N.

DESCRIPTION OF THE PREFERRED EMBODIMENT

Prior to a detailed description of the preferred method for an ink-jet head according to the present invention and an apparatus having an ink-jet head which uses the prefiring method, a description will be made of problems posed by the prefiring methods for an ink-jet head according to the related art with reference to FIGS. 1 and 2.

When ink-jet type printing heads are used, prefiring operations are executed, prior to printing operations, by blowing ink several times away from an ink-jet head for correcting a choked condition of the nozzles used therein, and thereby preventing characters from being printed faintly. Since a plurality of nozzles are disposed in an ink-jet head, it is necessary to prefire each of the printing nozzles.

The first prefiring operations for the printing nozzles are executed upon electrically energizing (switching ON time) an apparatus which incorporates an ink-jet head. Since the printing head (ink-jet head) has been unused or kept standing (switched OFF state) for a long time before the apparatus is electrically energized, a predetermined maximum number of prefiring operations are executed for clearing the printing nozzles. A maximum number is predetermined as 480, for example, for prefiring at normal temperature, but may optionally be modified depending on the type of character reader, ambient conditions and so on.

A certain period of time elapses after the electrical energization of the apparatus until the start of an actual printing operation. It is therefore necessary to execute prefiring operations before the printing operation. The number of prefiring operations to be executed at this stage is predetermined on the basis of the period of time which has elapsed after the preceding prefiring operations.

Assuming that prefiring operations are predetermined to be executed every minute, for example, ten prefiring operations are executed and ink is discharged ten times successively when ten minutes has passed after the preceding execution of prefiring operations.

Further, the prefiring operations for the printing nozzles are executed after printing operations have been made successively on a predetermined number of sheets. When the printing operations are to be made successively on a large number of sheets, it is impossible to uniformalize qualities of printed characters since the printing nozzles may be choked in the course of the printing operations. To prevent such an inconvenience, the prefiring operations for the printing nozzles are executed each time the printing operations have been made successively on 50 sheets, for example. A number of prefiring operations to be executed at such a stage is to be predetermined, like that of the prefiring operations to be executed before the start of the printing operations, on the basis of the period of time which has elapsed since the execution of preceding prefiring operations.

Figure 1:
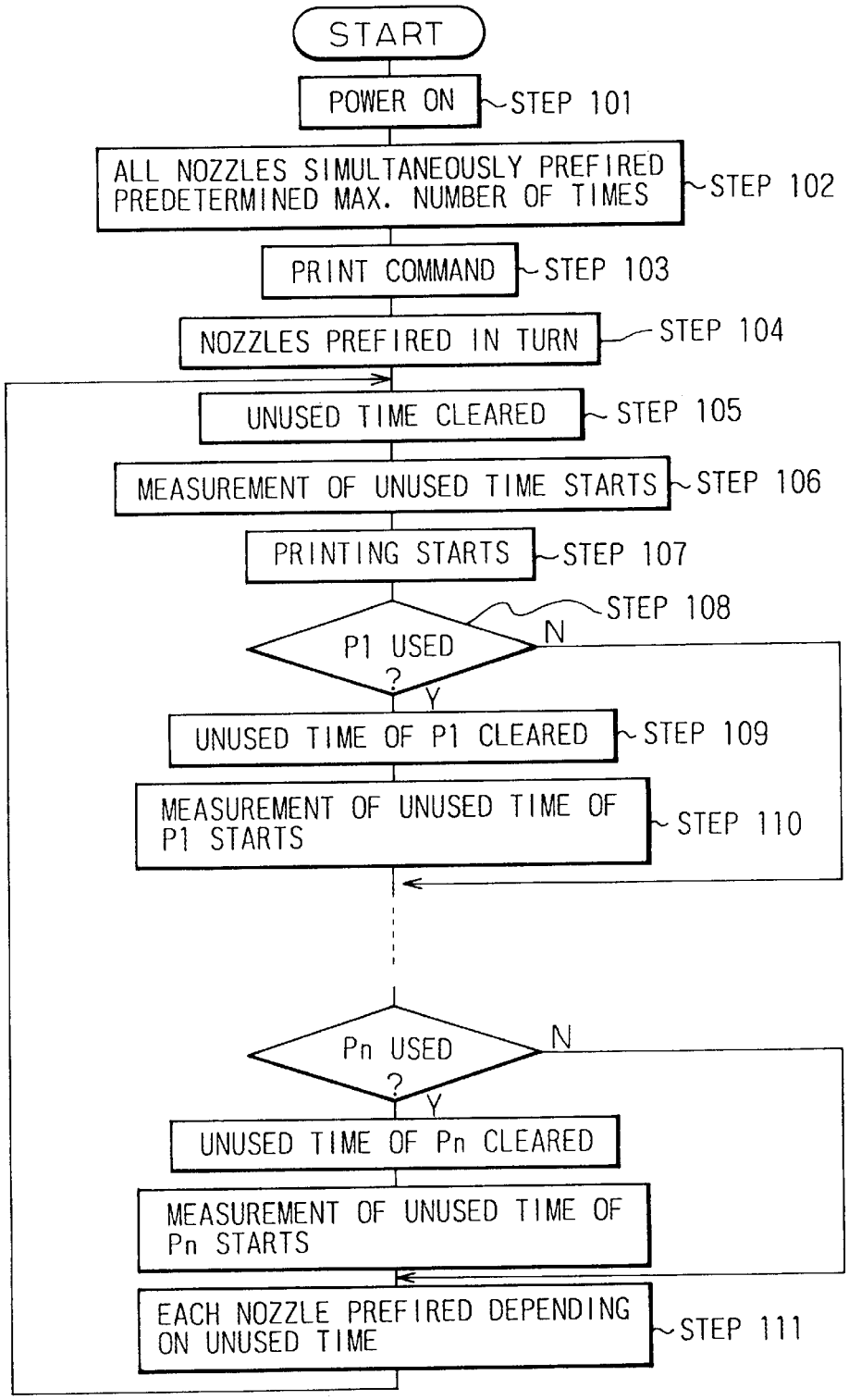
FIG. 1 is a flowchart showing an example of a prefiring method for an ink-jet head according to the related art.

FIG. 1 is a flowchart exemplifying procedures for carrying out a prefiring method according to the related art.

Upon electrically energizing an apparatus which incorporates an ink-jet head (Step 101), a predetermined maximum number (for example 480) of prefiring operations are executed for each of the printing nozzles at the same time (Step 102). Upon commanding printing operations at subsequent Step 103, the apparatus proceeds to Step 104, where the printing nozzles are prefired in turn. A number of the prefiring operations to be executed at this step is determined on the basis of the period of time which has elapsed since the preceding prefiring operations described above.

After the execution of the prefiring operations at Step 104, an unused period of time where each nozzle has been unused is cleared at Step 105 and a measurement of an unused time of each nozzle (printing nozzle) is started at Step 106.

By measuring the unused time of each nozzle, it is possible to execute the prefiring operations in a number matched with an actual operated condition thereof.

At next Step 107, the apparatus receives a print command and starts the printing operation. At Step 8, the apparatus determines an operated condition of each nozzle. Concretely, the apparatus determines, at Step 108, whether or not a first nozzle (a first printing nozzle) P1 has been operated. When the apparatus judges that the first nozzle P1 has been operated, it proceeds to Step 109 for clearing an unused time of the first nozzle which was measured at Step 106 and further proceeds to Step 110 for restarting a measurement of an unused time of the first nozzle P1. When the apparatus determines that the first nozzle P1 has not been operated at Step 108 on the other hand, it continues the measurement of the unused time which was started at Step 106.

When the apparatus determines that the first nozzle P1 has not been operated at Step 108 or when it restarts the measurement of an unused time of the first nozzle at Step 110, the apparatus similarly determines the operated conditions of a second nozzle P2 through an n'-th nozzle Pn at subsequent steps.

Concretely, the apparatus clears the unused time of each nozzle and restarts a measurement of the unused time thereof depending on an operated condition thereof.

Subsequently, the apparatus repeats the determination of an operated condition of each nozzle each time it carries out printing operations. When prefiring operations are to be executed at a subsequent step, the apparatus reads out an unused time of each nozzle, determines a number of prefiring operations to be executed for each nozzle (printing nozzle) dependently on an operated condition thereof and executes prefiring operations for all the nozzles (Step 111).

However, the prefiring method according to the related art described above requires excessive periods of time for prefiring and printing operations, since the method determines operated conditions of the printing nozzles through tedious procedures by checking an operated condition of each nozzle and measuring an unused time of each nozzle for determining a number of prefiring operations for each nozzle. When a single printing head tends to use an increased number of nozzles, in particular, the prolonged period of time which is required for determining the printing nozzles constitutes a cause for hindering the acceleration of printing operations.

As one method to solve this problem, it is possible to predetermine a number of prefiring operations to be executed for all nozzles on only the basis of the period of time which has elapsed after the preceding prefiring operations without measuring an unused time of each nozzle.

Figure 2:
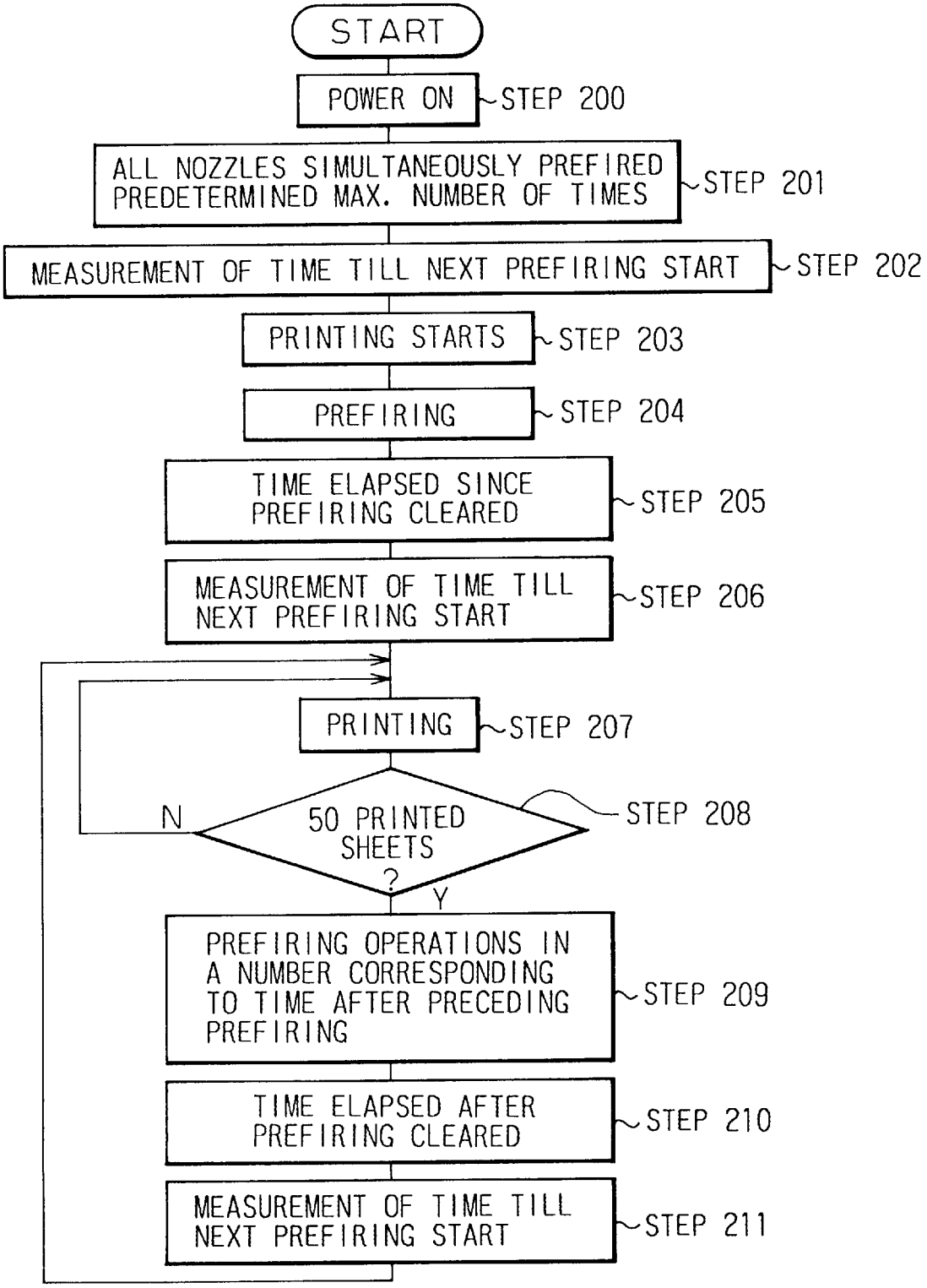
FIG. 2 is a flowchart showing another example of a prefiring method for an ink-jet head according to the related art.

FIG. 2 is a flowchart illustrating procedures for carrying out another prefiring method according to the related art.

After a predetermined number of prefiring operations are executed for all printing nozzles upon energizing an apparatus incorporating an ink-jet head as illustrated in FIG. 2 (Steps 200 and 201) as in the prefiring operations upon electrical energization at Steps 101 and 102 shown in FIG. 1, the apparatus starts, at Step 202, a measurement of a period of time which has elapsed since the preceding prefiring operation, or a measurement of a period of time which is to elapse until the next prefiring operation.

The apparatus starts printing operations at Step 203 and proceeds to Step 204, where all printing nozzles are prefired in a number of operations which is determined depending on the period of time elapsed since the preceding prefiring operations. The apparatus clears the period of time which is to elapse before the next prefiring operations at Step 205, and proceeds to Step 206 for restarting a measurement of a period of time which is to elapse before the next prefiring operations.

By the prefiring method for an ink-jet head illustrated in FIG. 2, each of the nozzles is prefired upon completing the printing operations on a predetermined number (for example 50) of sheets. Concretely, characters are printed out at Step 207, and the apparatus proceeds to Step 208 for determining whether or not the printing operations have been made on the predetermined number of sheets. When the apparatus determines that the printing operations have been made on 50 sheets, it proceeds to Step 209 for prefiring all the printing nozzles in a number of operations determined on the basis of a period of time which has elapsed after preceding prefiring operations. After executing the prefiring operations at Step 209, the apparatus clears the period of time until the next prefiring operations at Step 210 and proceeds to Step 211 for restarting a measurement of a period of time which is to elapse till the next prefiring operations.

The prefiring method illustrated in FIG. 2 eliminates the necessity to determine an operated condition of each nozzle and measure an unused time of each nozzle, and thereby shortens the periods of time which are required for the prefiring operations and the printing operations. However, the prefiring method shown in FIG. 2 allows all the printing nozzles to be subjected to the same number of prefiring operations which is determined mechanically on the basis of the period of time having elapsed after the preceding prefiring operations, but not on the basis of actual operated conditions of the printing nozzles.

Printing nozzles used in an ink-jet head are classified, depending on the locations thereof, into those which are operated frequently and others which are rarely operated. A printing nozzle which is disposed at a location for frequent use is generally to be used frequently after prefiring operations. Speaking of such a nozzle, a period of time which has elapsed after an immediately preceding ink discharge till prefiring operations is far shorter than a period of time which is to elapse after the preceding prefiring operations till the next execution of prefiring operations. When the printing nozzles which are used frequently are prefired in the number of operations determined on the basis of the period of time having elapsed after the preceding prefiring operations, ink (droplet of ink) is discharged (ejected) a number of times more often than required, and thereby posing a problem of an increased consumption of ink. Such an increase in ink consumption will shorten a service life (usable period of time) of an ink-jet print cartridge which is composed of an ink-jet head integrated with an ink reservoir.

Now, a detailed description will be made of the prefiring method for an ink-jet head according to the present invention and the apparatus incorporating an ink-jet head to which the prefiring method is applied.

Figure 3:
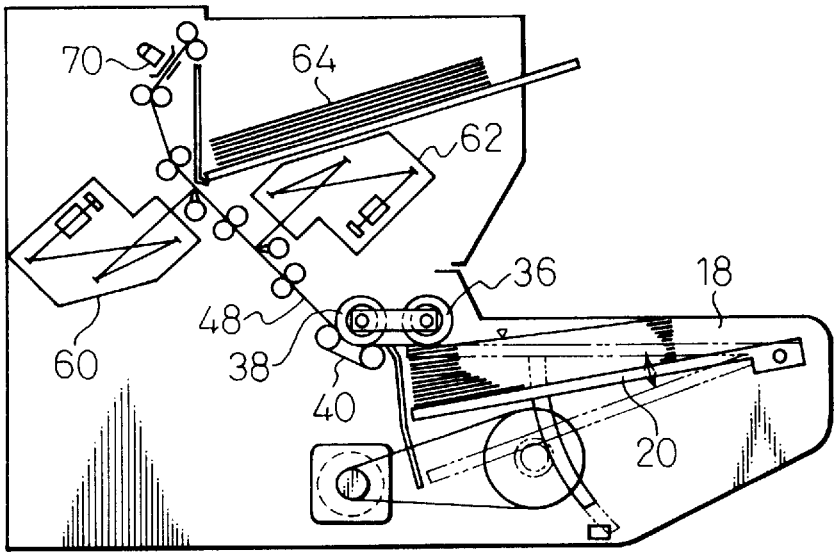
FIG. 3 is a diagram schematically showing an example of a character reader to which a prefiring method according to the present invention is applied.

FIG. 3 schematically shows an optical character reader (OCR) exemplifying the apparatus incorporating an ink-jet head to which the prefiring method according to the present invention is applied.

The character reader shown in FIG. 3 functions to feed a plurality of sheets mounted on a hopper 18 one by one into a carrier passage, reads characters with reading units 60 and 62, and discharges the sheets onto a stacker 64.

Disposed in a hopper section are a feeding roller 36 and a separating roller 38 which cooperate to feed the sheets mounted on the hopper 18 one by one. The two reading units (60 and 62) are used for reading characters which are printed on a front surface and a rear surface respectively of each of the sheets.

Upon completion of reading characters printed on a sheet, a completion mark indicating the completion of the reading operations is printed on the sheet for preventing the characters from being read out once again. A reference numeral 70 represents a printing unit (ink-jet print cartridge) which prints out the completion mark, an ordinal number of the sheet and other required symbols. The character reader shown in FIG. 3 uses an ink-jet print cartridge as the printing unit to which the prefiring method according to the present invention is applicable.

Since the character reader prints the completion marks on sheets which have been subjected to the character reading, it permits discriminating sheets which have not been subjected to the character reading due to jamming or overlapping in the carrier passage, or using the completion marks for determining whether or not sheets are to be subjected to the character reading once again.

Figure 4:
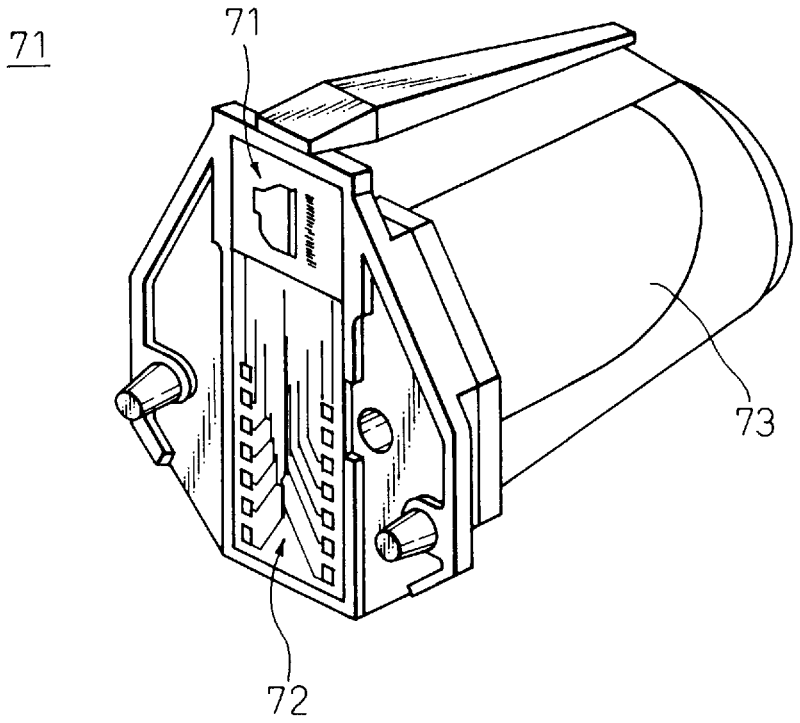
FIG. 4 is a perspective diagram showing a printing unit disposed in the character reader shown in FIG. 3.
Figure 5:
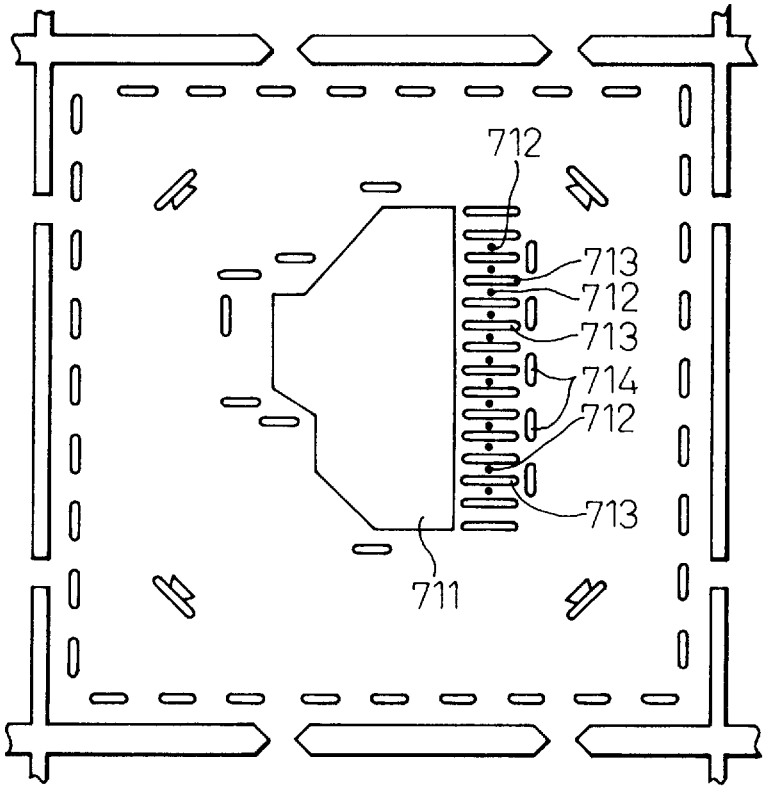
FIG. 5 is an enlarged diagram showing an ink-jet head portion in the printing unit shown in FIG. 4.

FIG. 4 shows the printing unit (ink-jet print cartridge) 70 of the character reader shown in FIG. 3, whereas FIG. 5 is an enlarged diagram showing an ink-jet head 71 portion in the printing unit shown in FIG. 4. In FIG. 5, a reference numeral 71 represents the ink-jet head, a reference numeral 72 designates a contact electrode, and a reference numeral 73 denotes an ink reservoir.

As seen from FIG. 4, the printing unit 70 is configured to be replaceable with another and to print out marks (numerals, symbols, etc.) with the ink-jet head 71 when the contact electrode 72 is brought into contact with an electrode disposed on the character reader. Since the printing unit is composed of the ink-jet head 71 integrated with the ink reservoir 73, the printing unit 70 is to be replaced with a new one as a whole including the ink-jet head 71 (and the contact electrode 72) when the ink reservoir 73 is empty.

Disposed in the ink-jet head 71 are a plurality of nozzles (12 in the example shown in FIG. 5) which are shielded with barriers as shown in FIG. 5 and configured to discharge ink according to signals provided by way of the contact electrode from the character reader. In FIG. 5, a reference numeral 711 represents a manifold for distributing ink, and a reference numeral 714 designates a slot. The ink-jet head shown in FIG. 5 is disposed so that sheets are fed in a horizontal direction relatively thereto and configured to print out characters each composed of 10 (12 maximum)×7 dots, while controlling ink discharge from the printing nozzles. Needless to say, ink-jet heads to which the prefiring method according to the present invention is applicable are not limited to that shown in FIG. 4 and FIG. 5.

Figure 6:
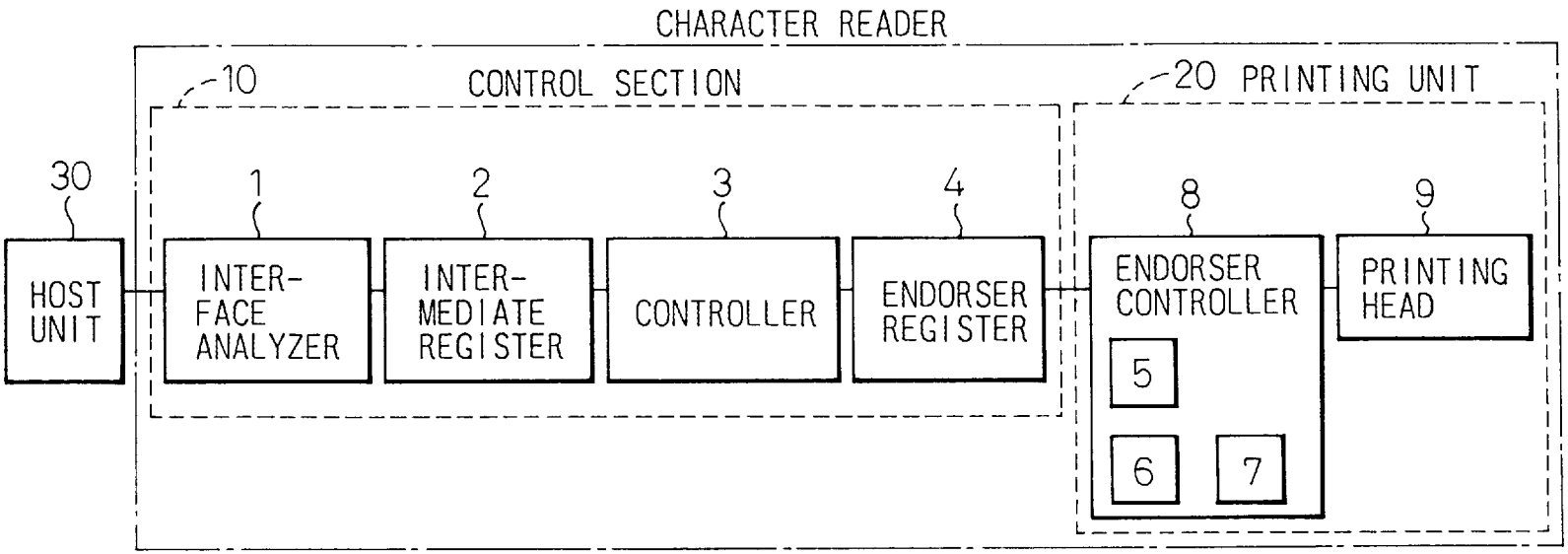
FIG. 6 is a block diagram showing a configuration of main members of an example of a character reader to which a prefiring method according to the present invention is applied.
Figure 8A:
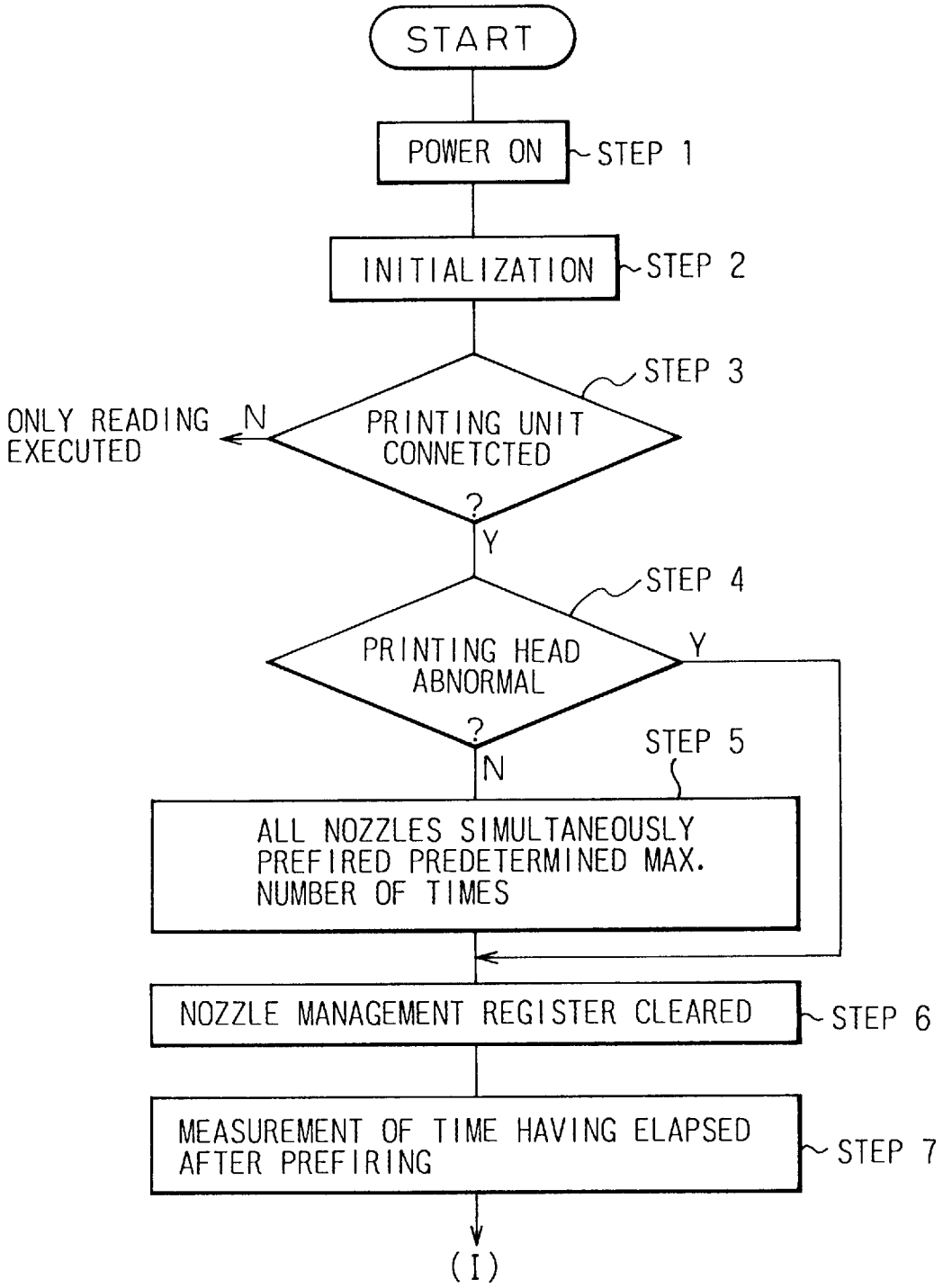
FIGS. 8A to 8D are flowcharts showing an embodiment of a prefiring method for an ink-jet head according to the present invention.
Figure 8B:
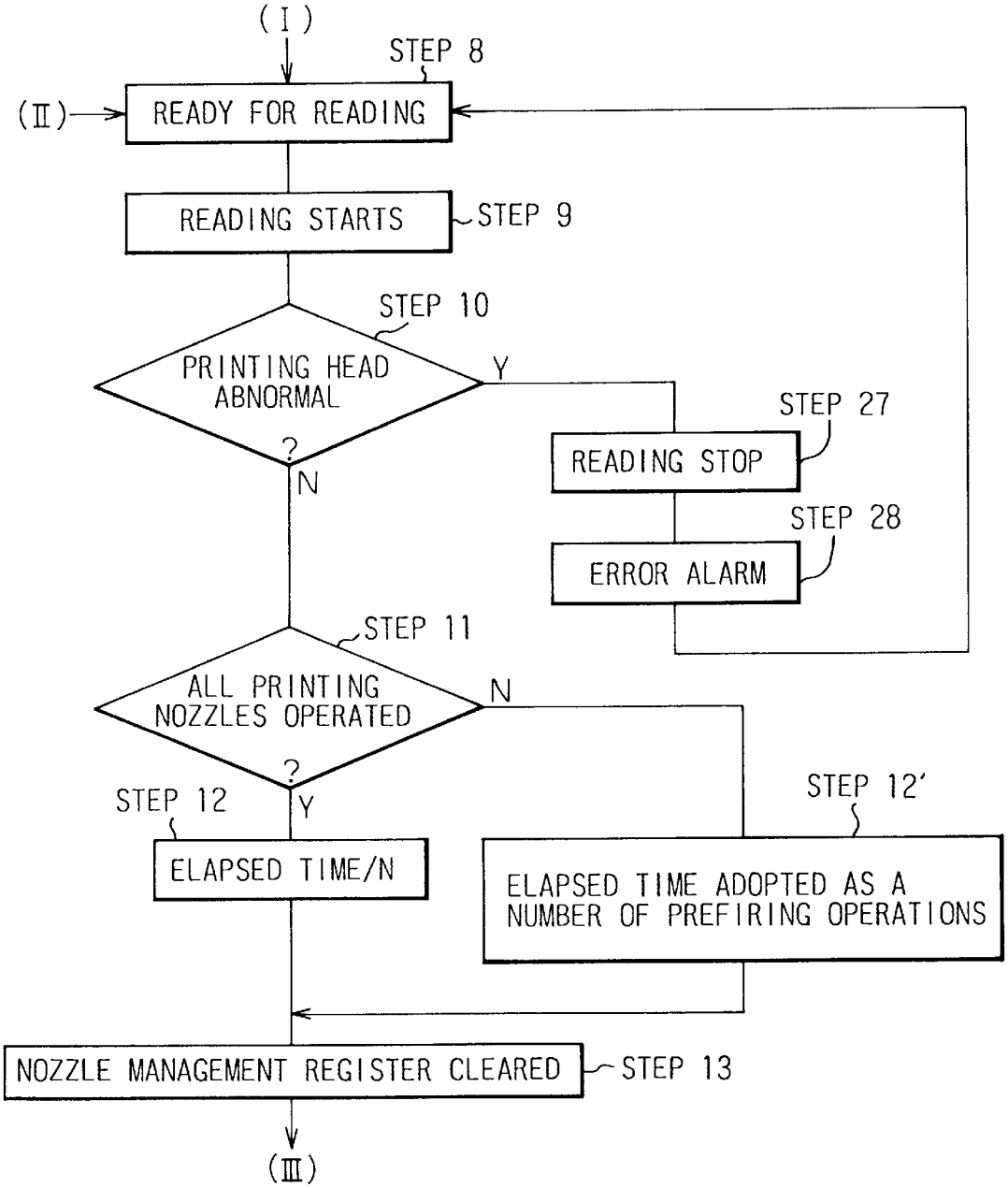
Figure 8C:
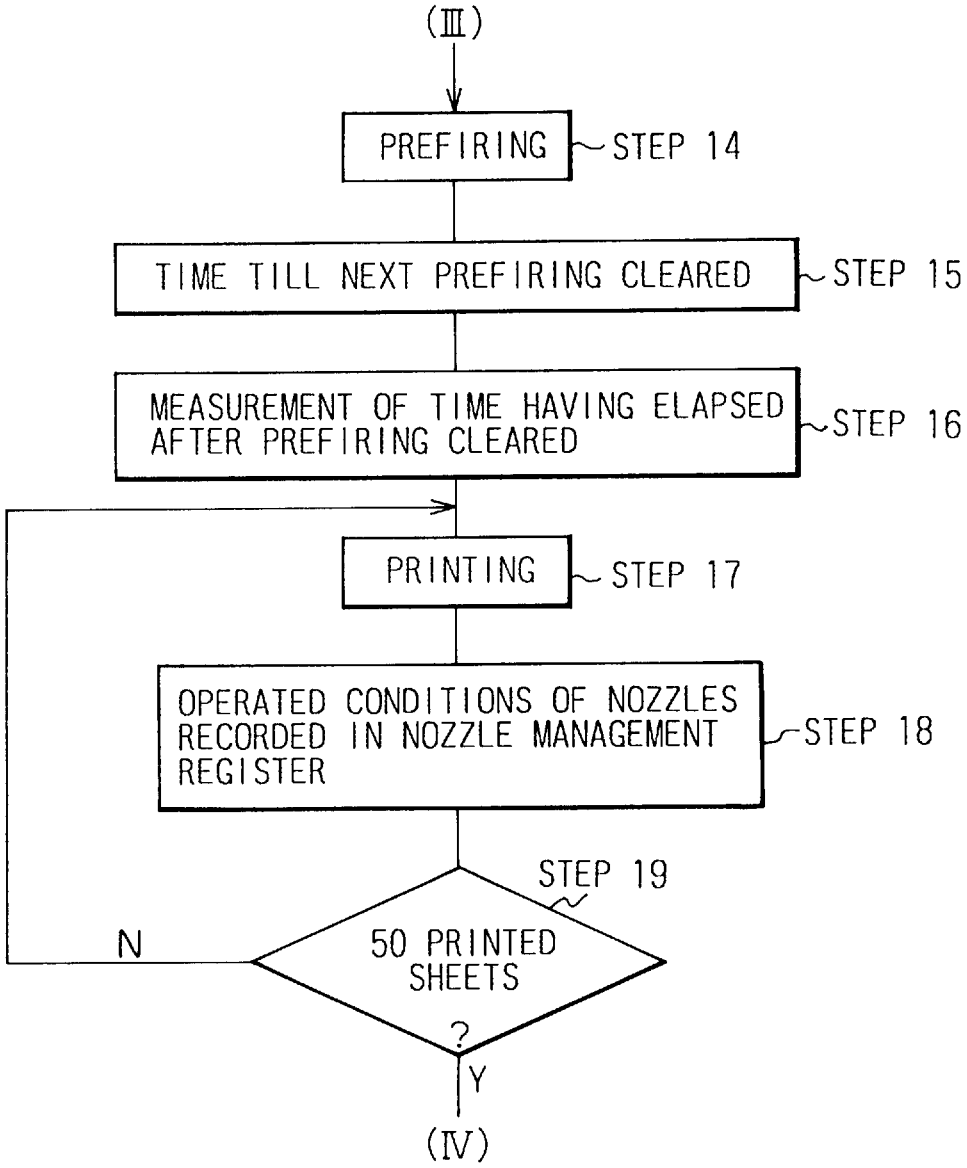
Figure 8D:
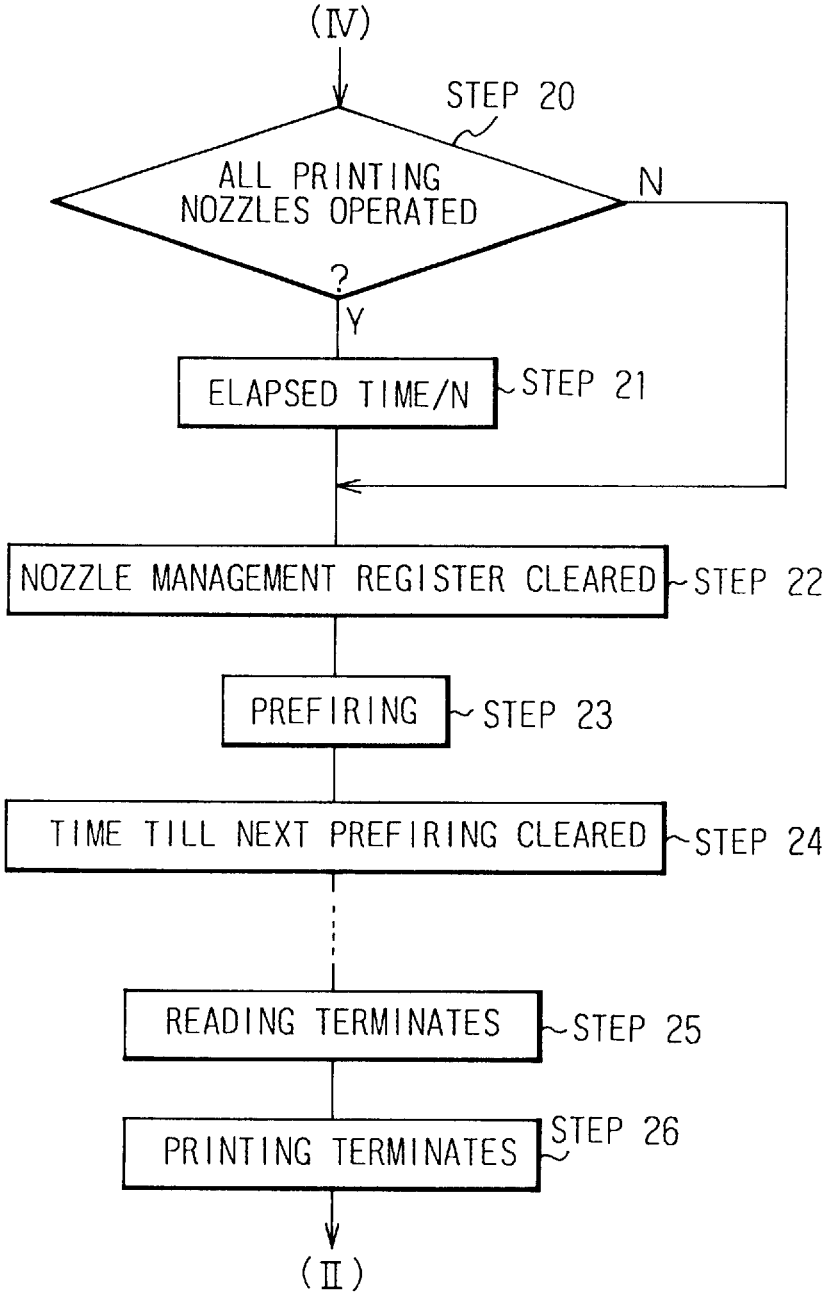

FIG. 6 shows a configuration of main members of a character reader to which the prefiring method according to the present invention is applied. In FIG. 6, a reference numeral 10 represents a controller for the character reader, a reference numeral 20 designates a printing unit and a reference numeral 30 denotes an externally connected host unit.

The reference numeral 1 represents an interface analyzer which is interposed between the controller and the host unit 30. The analyzer checks printing data sent from the host unit 30 for a format thereof and sets the data in the intermediate register 2, when the analyzer judges that the printing data has a normal format.

In FIG. 6, a reference numeral 3 represents a mechanical operation controller which controls the character reader. For printing operations, the mechanical operation controller 3 transmits print commands by way of an endorser register 4 to an endorser controller 8 to be described later, on the basis of the printing data set in the intermediate register 1, and thereby starting and commanding execution of prefiring operations.

The endorser controller 8 is disposed in a printing unit 20 and controls a printing head on the basis of print commands transmitted from the mechanical operation controller 3 for execution of printing operations and prefiring operations.

The endorser controller 8 further comprises a nozzle management register 5, an unused time counter 6, and a printed sheet number counter 7. The nozzle management register 5 records an operated condition of each of a plurality of printing nozzles (712) disposed in a printing head (71). The elapsed time counter 6 measures a period of time which has elapsed since the preceding prefiring operations. The printed sheet number counter 7, which is disposed in the endorser controller 8, adds one to a count value each time printing operations have been made on a single sheet, and is used for judging whether or not a predetermined number (for example, 50) of printed sheets has been reached. Details of operations performed by the nozzle management register 5, the elapsed time counter 6 and the printed sheet number counter 7 will be described later together with the prefiring operations. On the basis of the operated conditions stored in the register and count values stored in the counters, the endorser controller 8 controls the prefiring operations. In FIG. 4, when the printing head has 12 nozzles, for example, a nozzle management register (5) is constituted by registers having 2 bytes (16 bits) in total. Allocated to register No. 1 and register No. 2 are areas which correspond to printing nozzles to be controlled by these registers respectively. Since the printing head has the 12 nozzles in this case, register No. 2 has four areas which are unused.

When a printing nozzle is operated even once, the nozzle management register (5) sets "1" in a bit corresponding to the operated nozzle. While the printing nozzle is unused, "0" is set in the bit corresponding thereto.

In an initial condition, all the areas of the registers No. 1 and No. 2 are cleared. When a printing nozzle disposed in the printing head is operated even once after the character reader starts operating, "0" is changed into "1" in the bit corresponding to the operated nozzle. Further, all the areas of registers No. 1 and No. 2 are cleared once again upon execution of prefiring operations.

FIGS. 8A to 8D are flowcharts illustrating an embodiment of the prefiring method according to the present invention. Now, a description will be made of procedures for carrying out the embodiment of the prefiring method according to the present invention.

Upon electrically energizing (switching ON) a character reader incorporating an ink-jet head at Step 1 the character reader proceeds to Step 2 for initialization. At Step 3, the character reader determines whether or not a printing unit is connected thereto. Should a printing unit is not connected to the character reader, it executes only reading operations without printing out marks by using a printing unit (ink-jet print cartridge).

When the character reader determines that a printing unit is connected thereto, it proceeds to Step 4 for determining whether or not the printing head is abnormal. When the character reader determines that the printing head is free from abnormality, the character reader proceeds to Step 5 for executing a maximum number of prefiring operations for a plurality of nozzles disposed in the printing head at the same time. The character reader preferred for the embodiment of the present invention executes 480 prefiring operations at normal temperature.

Then, a nozzle management register (5) is cleared at Step 6. The nozzle management register records whether or not each of the printing nozzles disposed in the printing head is actually operated after it is prefired. Even when the character reader determines that the printing head is abnormal at Step 4, it proceeds to Step 6 for executing the similar operations. At Step 7, an elapsed time counter starts a measurement of a period of time which has elapsed after the start of the prefiring operations.

After the character reader is ready for reading characters at Step 8, it proceeds to Step 9, where it starts reading characters. Before the character reader starts actual character reading and carrying sheets, however, it determines whether or not the printing head is abnormal at Step 10.

When the character reader determines that the printing head is not abnormal at Step 10, it determines whether or not all the printing nozzles have been operated at Step 11. The determining at Step 11 is performed while referring to data recorded in the nozzle management register (5) and on the basis of reference results.

When the character reader determines that each of all the printing nozzles has been operated even once at Step 11, it proceeds to Step 12, where it divides, by N, the period of time which has elapsed since the preceding prefiring operations and was measured by the elapsed time counter at Step 7. Note that N is a coefficient having a value which is predetermined dependently on an operated frequency of a printing nozzle so as to be larger as the operated frequency is higher. A quotient obtained by dividing the elapsed period of time by N is set as a number of prefiring operations to be executed.

For predetermining the operated frequencies of the printing nozzles, the embodiment of the present invention counts the number of operations of the nozzles (printing nozzles or nozzles) and stores the number of operations of a nozzle which has been operated at a lowest frequency. A value of N is predetermined on the basis of the number of operations of the nozzle which has been operated at the lowest frequency so that a number of prefiring operations is determined dependently on the lowest operated frequency.

Though a total number of printing nozzle operations counted after a preceding prefiring operations may be adopted for determining a number of operations, the embodiment of the present invention calculates a mean number of operations for a predetermined period of time, for example, one minute. Reference is made to a table shown in FIG. 9 for determining a value of N.

FIG. 9 illustrates the relationship between the number of nozzle operations and values of the coefficient N, or lists values of N corresponding to a mean number of nozzle operations per minute. In FIG. 9, the coefficient N has a value which is larger for nozzles operated more times per minute, concretely 2 for a nozzle which is operated ten times per minute, 3 for a nozzle which is operated 20 or less times per minute, and so on. Accordingly, the coefficient N has a value which is larger for nozzles operated more times per minute. Accordingly, printing nozzles which are operated at higher frequencies are subjected to a smaller number of prefiring operations.

When the character reader determines that even one of the printing nozzles has never been operated after the preceding prefiring operations at Step 11, on the other hand, it proceeds to Step 12', where it sets a number of prefiring operations corresponding to the period of time elapsed after the preceding prefiring operations which was measured by the elapsed time counter at Step 7. When one prefiring operation is set for an elapsed time of one minute, the elapsed time (a number of minutes) is set as a number of prefiring operations to be executed.

After the nozzle management register is cleared at Step 13, the character reader proceeds to Step 14, where all the nozzles are subjected, at the same time, to prefiring operations in a number determined at Step 12 or 12' depending on a determination result obtained at Step 11.

Upon completing the prefiring operations, the character reader clears the measured period of time until the next prefiring operations and proceeds to Step 16 to restart a measurement of a period of time until the next prefiring operations. When printing operations are performed at Step 17, the nozzle management register (5) records operated conditions of the printing nozzles used for the printing operations at Step 18.

The character reader, which is preferred for the embodiment of the present invention, is configured to perform the prefiring operations, each time the printing operations have been made on 50 sheets. The character reader therefore determines, at Step 19, whether or not printing operations have been made on 50 sheets on the basis of a counted result obtained by the printed sheet number counter (7).

When the character reader judges that a number of printed sheets has reached 50 at Step 19, it proceeds to Step 20 for determining if each of the printing nozzles has been operated even once on the basis of data recorded by the nozzle management register (5). When the character reader determines that each of the printing nozzles has been operated even once at Step 20, it proceeds to Step 21, where it divides a period of time having elapsed after the preceding prefiring operations by the coefficient N determined on the basis of an operated frequency of the nozzle in the manner similar to that at Step 12, and thereby determining a number of prefiring operations to be executed. When the character reader determines that even one nozzle has not been operated, on the other hand, it sets a number of minutes having elapsed after the preceding prefiring operations as a number of prefiring operations to be executed.

After the data stored in the nozzle management register is cleared at Step 22, the character reader proceeds to Step 23 for executing prefiring operations in a number corresponding to the period of time elapsed since the preceding prefiring operations on the basis of the determination result obtained at Step 20. The time counter clears the data at Step 24 and it restarts the measurement of a period of time which is to elapse until the next prefiring operations. After the execution of the prefiring operations, the printed sheet number counter clears the data and restarts counting of the number of printed sheets.

Subsequently, the character reader repeats Steps 17 through 24 until character reading operations terminate at Step 25 and printing operations terminate at Step 26.

When the character reader determines that a number of printed sheets has not reached 50 at Step 19, the character reader returns by way of Step 17 to Step 18 to record the conditions of operated nozzles in the nozzle management register and determines whether or not a number of printed sheets has reached 50 at Step 19.

After the printing operations terminate at Step 26, the character reader returns to Step 8, where it is ready for the next reading operations while continuing the measurement of time lapsed.

In a case where the character reader determines that the printing head is abnormal at Step 10 in the process described above, it stops the reading operations at Step 27, transmits an error alarm at Step 28 and returns to Step 8 provided that the error is corrected at Step 28.

In the foregoing description, the fact that each of the printing nozzles has been operated even once indicates a fact that each nozzle has discharged (ejected) ink even once (a droplet of ink). The period of time which has elapsed after actual discharge of ink is shorter than the period of time which has elapsed after the preceding prefiring operations. Since the embodiment of the present invention is configured to set a number of prefiring operations which is smaller than a predetermined number when it determines that each of the printing nozzles has been operated even once, it is capable of shortening the time required for prefiring operations and preventing ink from being consumed in an amount larger than required.

Further, since the embodiment of the present invention determines a number of prefiring operations corresponding to a period of time which has elapsed after actual ink discharge, it is capable of executing prefiring operations matched with actual operated conditions of the printing nozzles. Owing to the fact that the embodiment of the present invention determines a number of prefiring operations only on the basis of data recorded by determining actual operated conditions of the printing nozzles, it eliminates the necessity to measure unused time of each nozzle. Accordingly, the embodiment of the present invention requires a smaller amount of data and shorter time for prefiring operations than those required by the prefiring method according to the related art described above.

When a nozzle which has not been operated even once after preceding prefiring operations is not subjected to a predetermined number of prefiring operations, on the other hand, this printing nozzle may be choked. The embodiment of the present invention executes a predetermined number of prefiring operations even for such a nozzle and is capable of securely preventing choking of all printing nozzles including those which have not been operated after the preceding prefiring operation in particular.

Moreover, a period of time which has elapsed after a final ink discharge from a printing nozzle till execution of prefiring operations is substantially shorter as the printing nozzle is operated at a higher frequency. Accordingly, it is possible to determine a number of prefiring operations which is matched to the operating frequencies of the printing nozzles, or a period of time which has elapsed after final operations of the printing nozzles, eliminate unnecessary ink discharge and shorten the periods of time required for prefiring operations by configuring a character reader, so as to count an operated frequency of each printing nozzle and determine a number of prefiring operations which is smaller as all printing nozzles are operated at higher frequencies (larger numbers of times).

Figure 10A:
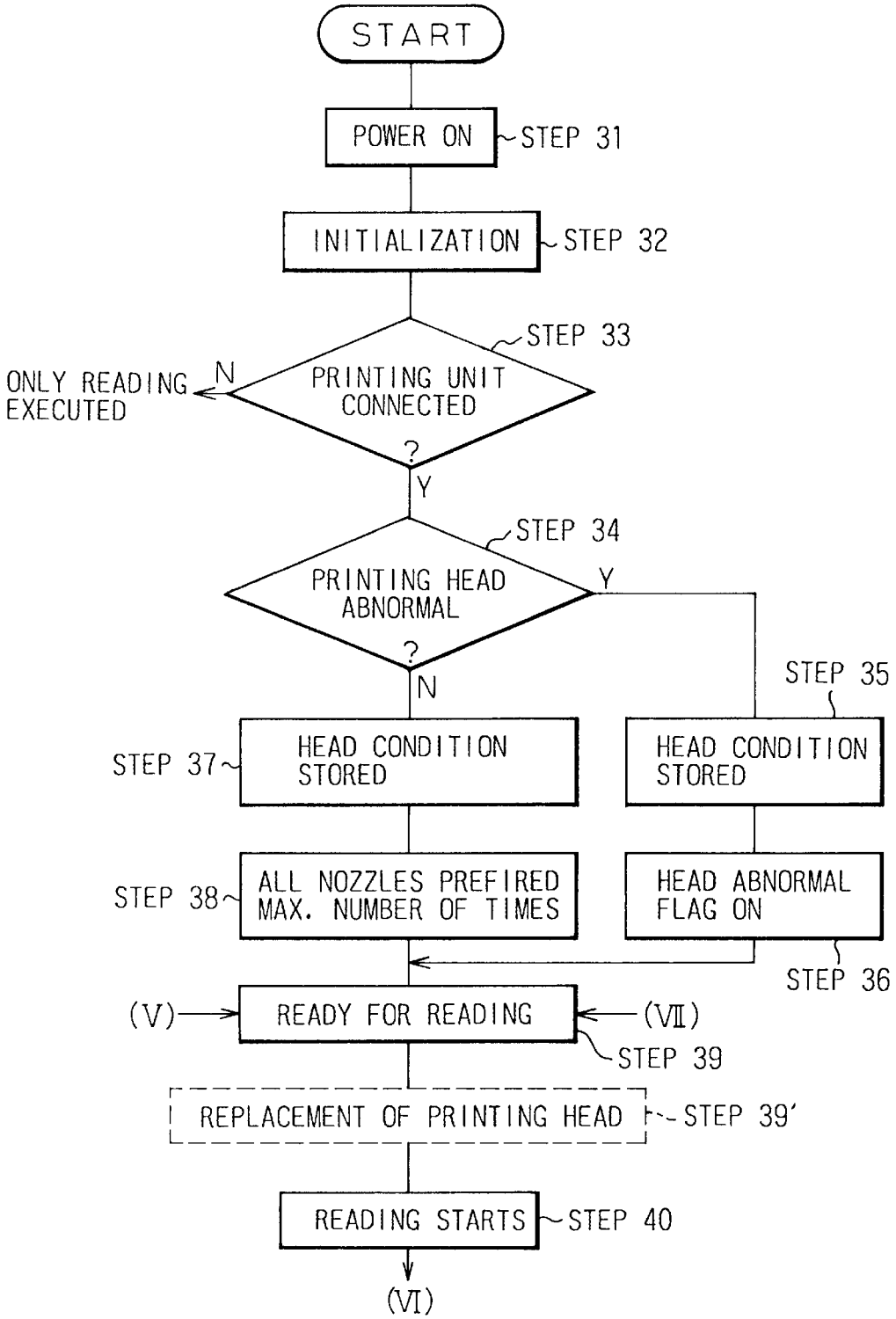
FIGS. 10A and 10B are flowcharts showing another embodiment of a prefiring method for an ink-jet head according to the present invention.
Figure 10B:
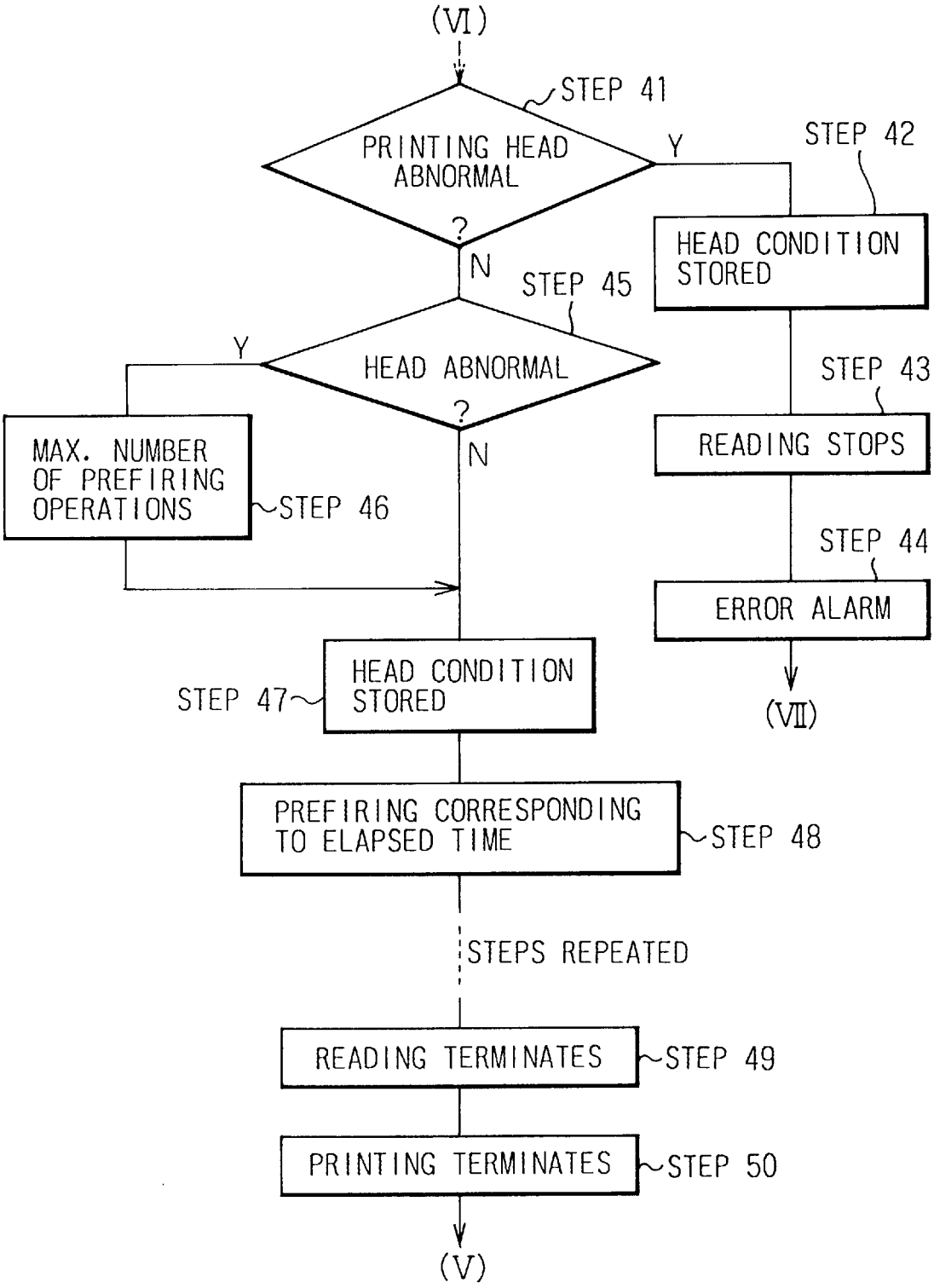

FIGS. 10A and FIG. 10B are flowcharts illustrating procedures for carrying out another embodiment of the present invention.

Description will be made of procedures for this embodiment including prefiring procedures to be executed after a printing head is replaced with a new one.

Upon electrically energizing a character reader at Step 31, it proceeds to Step 32, where initialization of the character reader is started. At Step 33, the character reader determines whether or not a printing unit is connected to the character reader. When the character reader determines that a printing unit is not connected, it executes reading operations only and does not print out marks with a printing unit.

When the character reader determines that a printing unit is connected at Step 33, on the other hand, it proceeds to Step 34 for determining whether or not a printing head is abnormal. When the character reader determines that the printing unit is abnormal at Step 34, it proceeds to Step 35 for storing a condition of the printing head and further proceeds to Step 36 for setting ON a head abnormal flag.

When the character reader determines that the printing head is free from abnormality at Step 34, it proceeds to Step 37 for storing a condition of the printing head and further proceeds to Step 38 for executing a predetermined maximum number of prefiring operations for each printing nozzle. At this step, each printing nozzle is prefired 480 times at normal temperature. Then, the character reader proceeds to Step 39 for getting ready for reading operations and starts the reading operations at Step 40.

The character reader further proceeds to Step 41 for determining whether or not the printing head is abnormal. When the character reader determines that the printing head is abnormal at Step 41, it stores a condition of the printing head at Step 42 and stops the reading operations at Step 43. Then, the character reader transmits an error alarm at Step 44 and returns to Step 39 provided that the error is corrected after Step 44.

When the character reader determines that the printing head is free from abnormality at Step 41, on the other hand, it proceeds to Step 45 for determining whether or not the printing head was abnormal, by checking whether or not the head abnormal flag was ON or OFF, at Step 36.

When the character reader determines that the printing head was free from abnormality, or the head abnormal flag was OFF, at Step 45, it proceeds to Step 47. When the character reader determines that the printing head was abnormal, or the head abnormal flag was ON, at Step 45, on the other hand, it executes the predetermined maximum number of prefiring operations at Step 46 and proceeds to Step 47.

The character reader stores the condition of the printing head at Step 47, and executes prefiring operations to a number matched with the period of time elapsed since the preceding prefiring operations and starts printing marks on sheets which have been subjected to the reading operations.

Subsequently, the character reader repeats the reading and printing operations until the reading operations terminate at Step 49 and the printing operations terminate at Step 50. Upon termination of the printing operations at Step 50, the character reader returns to Step 39 and is ready to restart the reading operations.

Now, a description will be made of steps to be followed in a case where the printing head is replaced with a new one at Step 39'. When the character reader determines that the printing head is abnormal at Step 34, prefiring operations are not executed, unlike the case where the character reader determines that the printing head is free from abnormality.

Since the new printing head has never been operated before and has been kept standing for a long time, it is necessary to execute the predetermined maximum number of prefiring operations before operating the new printing head. The embodiment of the present invention determines whether or not the printing head has been replaced with a new one by checking the head abnormal flag for an ON/OFF condition at Step 45.

Concretely, the head abnormal flag is set at ON before the printing head is replaced with a new one, or while the abnormal printing head is used. After the printing head is replaced with a new one, on the other hand, a printing head free from abnormality is set in position and this fact has been confirmed at Step 41. The condition of the printing head which is set in the character reader does not correspond to the condition of the head abnormal flag at Step 45 after the printing head is replaced with a new one.

Conversely, a condition of the head abnormal flag which does not correspond to the condition of the printing head indicates that the printing head has been replaced with a new one. The embodiment of the present invention is characterized in that it utilizes this fact, or checks for correspondence between a condition of the printing head and a condition of the head abnormal flag, detects replacement of the printing head and executes the predetermined maximum number of prefiring operations, when the character reader determines that the printing head has been replaced with a new one.

Accordingly, the embodiment of the present invention allows the character reader to detect replacement of the printing head and execute the predetermined maximum number of prefiring operations, and thereby prevent marks and symbols from being printed out faintly even printing operations are started immediately after replacement of the printing head.

As understood from the foregoing description, the prefiring method according to the present invention makes it possible to determine the number of prefiring operations matched with actual operated conditions of printing nozzles through simple procedures, and to shorten the periods of time required for prefiring the printing nozzles and execute prefiring operations in a number matched with the actual operated conditions of the printing nozzles.

Owing to the fact that the prefiring method according to the present invention records an operated condition of each nozzle, in particular, it allows a character reader to execute a number of prefiring operations which is matched with an unused nozzle even when any one of printing nozzles is not operated even once, and thereby preventing an ink-jet head from being choked. Further, the prefiring method according to the present invention determines the number of prefiring operations depending on an operated frequency of an ink-jet head and adopts a smaller number of prefiring operations for an ink-jet head which is operated at a high frequency, thereby eliminating useless ink discharge and shortening the periods of time required for useless ink discharge.

Moreover, the prefiring method according to the present invention which is configured to execute prefiring operations upon detecting the replacement of a printing head allows a new printing head to be prefired securely, and is thereby capable of improving the quality of the printed marks and symbols immediately after replacement of a printing head with the new one. The prefiring method according to the present invention permits determining replacement of a printing head on the basis of a current condition of printing head and a past condition of a printing head, and thereby making it possible to execute prefiring operations effectively upon replacement of a printing head and eliminating the necessity to use a means for detecting whether or not a printing head is mounted in position.

Many different embodiments of the present invention may be constructed without departing from the spirit and scope of the present invention, and it should be understood that the present invention is not limited to the specific embodiments described in this specification, except as defined in the appended claims.

What is claimed is:

1. An apparatus having an ink-jet head including a plurality of printing nozzles comprising:

a time measuring means for measuring an elapsed time from a last execution of a prefiring operation for said ink-jet head;

a recording means for recording whether or not said plurality of printing nozzles are operated; and a prefiring operation control means for determining a number of prefiring operations in accordance with a) a measurement result obtained by said time measuring means and b) operated conditions of said plurality of printing nozzles recorded in said recording means, and for executing prefiring operations for said ink-jet head.

2. An apparatus having an ink-jet head as claimed in claim 1, wherein said recording means is constituted to record whether or not said plurality of printing nozzles disposed in said ink-jet head are operated.

3. An apparatus having an ink-jet head as claimed in claim 1, wherein said prefiring operation control means is constituted to initialize a time measured by said time measuring means, and also to initialize operated conditions of said plurality of printing nozzles recorded in said recording means when the prefiring operation for said ink-jet head is carried out.

4. An apparatus having an ink-jet head as claimed in claim 1, wherein said prefiring operation control means determines a number of prefiring operations in accordance with an elapsed time, from preceding prefiring operations which is measured by said time measuring means when the operated conditions of said plurality of printing nozzles are not recorded in said recording means, and said prefiring operation control means determines a number of prefiring operations by dividing, by a specific value, an elapsed time from the preceding prefiring operations, which is measured by said time measuring means when the operated conditions of said plurality of printing nozzles are recorded in said recording means.

5. An apparatus having an ink-jet head as claimed in claim 4, wherein said recording means records numbers of operations of said plurality of printing nozzles, said prefiring operation control means determines the specific value corresponding to the number of operations of said plurality of printing nozzles recorded in said recording means, and said prefiring operation control means determines a number of prefiring operations by dividing the elapsed time from the preceding prefiring operations by the specific value.

6. An apparatus having an ink-jet head as claimed in claim 1, wherein said apparatus further comprises:

a condition detecting means for detecting whether or not said ink-jet head is abnormal;

a condition recording means for recording the abnormal condition of said ink-jet head;

a condition judging means for determining a condition of said ink-jet head at the time of the recording; and a checking means for comparing the condition recorded in said condition recording means with the condition of said ink-jet head determined by said condition judging means, wherein said prefiring operation control means executes prefiring operations for said ink-jet head, when the condition recorded in said condition recording means is different from the condition of said ink-jet head determined by said condition judging means.

7. An apparatus having an ink-jet head as claimed in claim 1, wherein said apparatus further comprises:

a head replacement determining means for judging whether or not said ink-jet head was replaced with a new one, wherein said prefiring operation control means executes prefiring operations for said ink-jet head, when said head replacement determining means judges that said ink-jet head was replaced with the new one.

8. An apparatus having an ink-jet head as claimed in claim 1, wherein said apparatus further comprises a printed sheet number counting means for counting printed sheets, and said prefiring operation control means executes prefiring operations for said ink-jet head, when the printed sheets counted by said printed sheet number counting means reach a predetermined number.

9. An image reader comprising:

an image reader controller connected to a host unit, an endorser controller connected to said image reader controller, and an ink-jet including a plurality of printing nozzles and controlled by said endorser controller, a prefiring operation control means includes an unused time counter for measuring an elapsed time from execution of a last prefiring operation for said ink-jet head; and a nozzle management register for recording whether or not said plurality of printing nozzles are operated, wherein said endorser controller determines a number of prefiring operations in accordance with a) a measurement result obtained by said unused time counter and b) operated conditions of said plurality of printing nozzles recorded in said nozzles management register, and said endorser controller executes prefiring operations for said ink-jet head.

10. An image reader as claimed in claim 9, wherein said image reader controller comprises:

an interface analyzer, connected to said host unit, for checking printing data sent from said host unit for a format thereof;

an intermediate register, connected to said interface analyzer, for storing the printing data sent from said interface analyzer, when said interface analyzer determines that the printing data has a normal format;

a mechanical operation controller, connected to said intermediate register, for controlling mechanical operations of said image reader by outputting print commands; and an endorser register, connected to said mechanical operation controller, for transferring the print commands from said mechanical operation controller to said endorser controller.

11. An image reader as claimed in claim 10, wherein said nozzle management register is constituted to record whether or not said plurality of printing nozzles disposed in said ink-jet head are operated.

12. An image reader as claimed in claim 10, wherein said endorser controller is constituted to initialize the time measured by said unused time counter, and also to initialize operated conditions of said plurality of printing nozzles recorded in said nozzle management register when the prefiring operation for said ink-jet head is carried out.

13. An image reader as claimed in claim 10, wherein said endorser controller determines a number of prefiring operations in accordance with an elapsed time, from preceding prefiring operations, which is measured by said unused time counter when the operated conditions of said plurality of printing nozzles are not recorded in said nozzle management register, and said endorser controller determines a number of prefiring operations by dividing, by a specific value, an elapsed time from the preceding prefiring operations which is measured by said unused time counter when the operated conditions of said plurality printing nozzles are recorded in said nozzle management register.

14. An image reader as claimed in claim 13, wherein said nozzle management register records the number of operations of said plurality of printing nozzles, said endorser controller determines the specific value corresponding to the number of operations of said plurality of printing nozzles recorded in said nozzle management register, and said endorser controller determines a number of prefiring operations by dividing the elapsed time from the preceding prefiring operations by the specific value.

15. An image reader as claimed in claim 10, wherein said image reader further comprises:

a condition detecting means for detecting whether or not said ink-jet head is abnormal;

a condition recording means for recording the abnormal condition of said ink-jet head;

a condition determining means for judging a condition of said ink-jet head at the time of the recording; and a checking means for comparing the condition recorded in said condition recording means with the condition of said ink-jet head determined by said condition judging means, wherein said endorser controller executes prefiring operations for said ink-jet head, when the condition recorded in said condition recording means is different from the condition of said ink-jet head determined by said condition judging means.

16. An image reader as claimed in claim 10, wherein said image reader further comprises:

a head replacement judging means for determining whether or not said ink-jet head was replaced with a new one, wherein said endorser controller executes prefiring operations for said ink-jet head, when said head replacement judging means determines that said ink-jet head has been replaced with the new one.

17. An image reader as claimed in claim 10, wherein said image reader further comprises a printed sheet number counter for counting printed sheets, and said endorser controller executes prefiring operations for said ink-jet head, when the printed sheets counted by said printed sheet number counter reach a predetermined number.

18. A prefiring method for an ink-jet head constituted to prevent choking of a plurality of printing nozzles disposed in said ink-jet head by discharging ink from said printing nozzles, wherein said prefiring method comprises the steps of:

measuring an elapsed time from execution of a last prefiring operation for said ink-jet head;

recording operated conditions of said plurality of printing nozzles after the execution of the last prefiring operation;

determining a number of prefiring operations in accordance with the elapsed time from the last execution of the prefiring operation for said ink-jet head and the operated conditions of said plurality of printing nozzles; and executing the determined number of prefiring operations for said plurality of printing nozzles of said ink-jet head.

19. A prefiring method for an ink-jet head as claimed in claim 18, wherein said operated condition recording step records operated conditions of each of said plurality of printing nozzles disposed in said ink-jet head.

20. A prefiring method for an ink-jet head as claimed in claim 18, wherein said prefiring number determining step determines a number of prefiring operations corresponding to the elapsed time from the execution of the last prefiring operation when said plurality of printing nozzles are not operated even once, and determines a number of prefiring operations as a quotient obtained by dividing the elapsed time from execution of the last prefiring operation by a specific value determined in accordance with the operated conditions of said plurality of printing nozzles.

21. A prefiring method for an ink-jet head as claimed in claim 20, wherein said prefiring number determining step determines a number of prefiring operations corresponding to the elapsed time from the execution of the prefiring operations when any one of said plurality of printing nozzles are not operated.

22. A prefiring method for an ink-jet head as claimed in claim 20, wherein said time measuring step counts operated frequencies of said plurality of printing nozzles disposed in said ink-jet head, and said prefiring number determining step determines a number of prefiring operations by dividing the elapsed time from the execution of the prefiring operations by the specific value determined in accordance with the operated frequencies of said plurality of printing nozzles.

23. A prefiring method for an ink-jet head as claimed in claim 18, wherein said prefiring method further comprises the steps of:

detecting an abnormal condition of said ink-jet head;

recording the abnormal condition of said ink-jet head;

determining a condition of said ink-jet head before the execution of the prefiring operations; and checking the recorded condition of said ink-jet head against the determined condition thereof, wherein said prefiring operation executing step executes prefiring operations for said ink-jet head, when the checked results are not coincident with each other.

24. A prefiring method for an ink-jet head as claimed in claim 18, wherein said prefiring method further comprises the step of determining whether or not said ink-jet head was replaced with a new one, wherein said prefiring operation executing step executes prefiring operations for said ink-jet head, when said ink-jet head has been replaced with the new one.

25. A prefiring method for an ink-jet head as claimed in claim 18, wherein said prefiring operation executing step executes prefiring operations for said ink-jet head, when the number of printed sheets printed by said ink-jet head reaches a predetermined number.

* * * * *